US010156052B2

(12) United States Patent
Huber

(10) Patent No.: US 10,156,052 B2
(45) Date of Patent: Dec. 18, 2018

(54) CONTAINMENT MEMBRANE

(71) Applicant: Garland Industries, Inc., Cleveland, OH (US)

(72) Inventor: Michael D. Huber, Cleveland, OH (US)

(73) Assignee: Garland Industries, Inc., Cleveland, OH (US)

( * ) Notice: Subject to any disclaimer, the term of this patent is extended or adjusted under 35 U.S.C. 154(b) by 257 days.

(21) Appl. No.: 14/983,980

(22) Filed: Dec. 30, 2015

(65) Prior Publication Data

US 2016/0194849 A1 Jul. 7, 2016

Related U.S. Application Data

(60) Provisional application No. 62/100,153, filed on Jan. 6, 2015.

(51) Int. Cl.
*E02D 31/00* (2006.01)
*E02D 3/00* (2006.01)

(52) U.S. Cl.
CPC ..... *E02D 31/002* (2013.01); *E02D 3/00* (2013.01)

(58) Field of Classification Search
CPC ..... E02D 31/002
USPC ..... 220/9.1–9.4, 573; 405/52, 270, 60, 405/129.75, 29.551
See application file for complete search history.

(56) References Cited

U.S. PATENT DOCUMENTS

| | | | | |
|---|---|---|---|---|
| 5,507,900 | A * | 4/1996 | Mohammed | B09B 1/00 156/157 |
| 6,120,876 | A * | 9/2000 | Walton | F16N 31/006 180/69.1 |
| 6,755,596 | B2 * | 6/2004 | Schibi | E02B 5/02 405/270 |
| 2012/0219746 | A1 * | 8/2012 | Powell | B32B 5/022 428/57 |
| 2013/0121768 | A1 * | 5/2013 | Powell | E02D 29/02 405/114 |

* cited by examiner

*Primary Examiner* — Sunil Singh
(74) *Attorney, Agent, or Firm* — Fay Sharpe LLP

(57) ABSTRACT

A liquid resistant containment membrane and which is durable enough to remain in place during the drilling and fracking phases to eliminate the delay and cost of replacement or can be relocated from site to site, has a slip resistant top surface, is a flexible membrane, and/or which top portion of the containment membrane does not absorb liquids. The containment membrane comprises a polymer waterproof layer and a reinforcement layer. The reinforcement layer is connected to a bottom side of the polymer waterproof layer.

31 Claims, 4 Drawing Sheets

CONTAINMENT MEMBRANE

CROSS-REFERENCE TO RELATED APPLICATIONS

This application claims priority to U.S. Provisional Patent Application Ser. No. 62/100,153, filed on Jan. 6, 2015. The entirety of that application is hereby fully incorporated by reference in its entirety.

BACKGROUND ON THE INVENTION

The present invention is directed to a liquid-resistant membrane, particularly to a multilayer liquid-resistant membrane, and more particularly to a multilayer liquid-resistant membrane that can be used as a containment membrane.

In various types of environments, containment systems are used to prevent contaminants or other undesired materials from contacting a ground source and/or being absorbed into the ground. For example, in the fracking industry, the region about a well or potential well is commonly covered by a containment membrane to prevent fracking liquids and other materials from contaminating the area about the well.

These containment membranes are typically in service for approximately four to six months during the drilling phase. Upon conclusion of drilling, the membranes are commonly damaged and are removed because of use and abuse after removal of the drilling rigs and associated equipment. Another membrane (typically similar to the first) is installed prior to the fracking phase. It is also commonly in place approximately four to six months, then removed.

Containment membranes are typically laid upon a rough stone prepared site and are designed to be puncture resistant from the bottom side so that sharp rocks and/or debris underneath the containment membrane do not easily puncture the membrane. Generally, the containment membrane needs to be durable enough to withstand heavy equipment being driven and/or moved on the containment membrane.

The types of prior art containment membranes fall into two varieties. The first variety is a modified tarpaulin material that is thin and composed of a thermoplastic material with a light reinforcement. The reinforcement material is thicker than the thermoplastic material. This type of containment membrane is considerably cheaper to purchase and install, but does not have the necessary durability to remain in place through the drilling and fracking phases. These containment membranes are typically removed and replaced between the two separate operations (e.g., drilling and fracking). The second variety of prior art containment membrane utilizes a non-woven fabric above and below the thin waterproofing material. The fabric below the waterproofing material acts as the puncture resistant layer to prevent rock penetration. The fabric layer above the waterproofing material is used to provide slip resistance. These two fabric membranes get heavy when wet and, over time, absorb contaminating material. The fabric material located above the waterproofing material is also difficult to clean. Both fabric layers are thicker than the thin waterproofing material.

In view of the current state of the art of containment membranes, there remains a need for a containment membrane that is durable enough to remain in place during drilling and fracking phases (to eliminate the delay and cost of replacement), has a slip resistant top surface (which top portion of the containment membrane does not absorb liquids), and can be relocated (e.g., moved from one site to another).

SUMMARY OF THE INVENTION

The present invention is directed to a liquid-resistant membrane that can be used as a containment membrane and which is durable enough to remain in place during the drilling and fracking phases to eliminate the delay and cost of replacement, has a slip resistant top surface, is a flexible membrane, and which top portion of the containment membrane does not absorb liquids.

The containment membrane of the present invention can be liquid-resistant and durable enough to remain in place during the drilling and fracking phases, thus eliminating the delay and cost of replacement. Alternatively, the containment membrane can be easily and conveniently relocated from site to site. The containment membrane of the present invention can be used in conjunction with a berm or curb portion that is used to define a space or pit opening upwardly and encompassing the general containment area.

According to another non-limiting embodiment of the present invention, the containment membrane can comprise a first layer and a second layer. The first layer can be a polymer waterproof layer. The second layer can be a reinforcement layer. In one non-limiting embodiment, the polymer waterproof layer can be a high-density polyethylene (HDPE) plastic, a low-density polyethylene (LDPE) plastic, a rubber material, polyvinyl chloride (PVC), various types of resins, various types of resin epoxies, polyester, polypropylene, polyurethane, polyacrylate, and copolymers thereof, etc. The reinforcement layer can be a fabric material; however, this is not required. The reinforcement material can include one or more additional layer to provide additional protection; however, this is not required. The reinforcement layer can be connected to a bottom side of a waterproof layer wherein the top surface of the polymer waterproof layer is absent the reinforcement layer; however, this is not required. The reinforcement layer is generally fully coated with the polymer waterproof layer; however, this is not required. The texture of the reinforcement layer can generally be felt or visually seen in the bottom of the containment membrane, but cannot be felt or visually seen on the top of the containment membrane; however, this is not required. As can be appreciated, other configurations of the two containment membrane layers can be used.

In another and/or additional aspect of the present invention, at least a portion of the reinforcement layer is impregnated with the polymer waterproof layer to form the containment membrane. The polymer waterproof layer can be used to partially or fully impregnate all of or only a portion of the reinforcement layer. The polymer waterproof layer is typically applied to the reinforcement layer by a dipping process and/or a spray coating process; however, other or additional coating processes can be used.

The containment membrane of the present invention can include a polymer waterproof layer that is engineered to be flexible, yet durable.

In another non-limiting embodiment of the invention, the reinforcement layer is formed by a plurality of fibers. The fibers used in the reinforcement layer can be woven fibers, non-woven fibers or some mixture thereof. The reinforcement layer may or may not include any stitching of the fibers. In one non-limiting aspect of the present invention, many different types of fiber materials can be used to form the reinforcement layer. The reinforcement layer can be formed of the same or different compositional type of fibers. The fibers in the fabric layer can have the same or differently sized and/or shaped cross-sectional area. In one non-limiting embodiment of the invention, the fibers can include materials such as, but not limited to, glass fibers (e.g., silica glass, aramid glass, etc.), carbon fibers, quartz fibers, Kevlar® fibers, boron fibers, polyethylene fibers, polyamide fibers, polypropylene fibers, etc. The fibers can be formed of a single material or be a hybrid of one or more materials. In another and/or additional non-limiting embodiment of the invention, a majority of the fibers in the reinforcement layer are non-woven fibers. In still another and/or additional non-limiting embodiment of the invention, a majority of the fibers in the reinforcement layer are woven fibers such as, but not limited to, a roving of fibers. In yet another and/or additional non-limiting embodiment of the invention, several sets of fibers are oriented together and then at least partially secured in position relative to one another to form the reinforcement layer. In one non-limiting aspect of this embodiment, at least one set of fibers is formed of a plurality of fibers. The shape, size, color and/or composition of the fibers in each set of fibers can be the same or different. In one non-limiting design, the shape, size and composition of a majority of the fibers in at least one set of fibers are substantially the same. In another and/or additional non-limiting design, a majority of the fibers in at least one set of fibers are non-woven fibers (e.g., laid fibers, etc.). In still another and/or additional non-limiting design, a majority of the fibers in at least one set of fibers are woven fibers. In yet another and/or additional non-limiting design, at least a portion of the fibers in at least one set of fibers are non-woven fibers and at least a portion of the fibers are non-woven fibers. For instance, the core of a set of fibers could be woven or non-woven fibers and the outer region of the set of fibers could be formed of non-woven or woven fibers. In still another and/or additional aspect of the present invention, the reinforcement layer includes a fiber group that includes plurality of fibers that are laid in a generally parallel relationship to one another. The fiber group can be formed of one set of fibers or a plurality of sets of fibers. When the fiber group is formed from a plurality of fiber sets, one or more of the fibers sets can be spaced next to one another, overlap one another, or be spaced apart from one another. When the fiber group is formed by a plurality of fiber sets, each fiber set generally has the same number of fibers; however, this is not required. The number of fibers in a fiber set generally is about 2-500000, and typically about 5-10000, and more typically about 10-1000; however, other numbers of fibers in a fiber set can be used. Typically, the fiber set includes a plurality of layers of fibers; however, this is not required. The thickness of at least one fiber set is generally at least about 0.05 mm, and typically at least about 0.1 mm; however, other thickness can be used. The width of a fiber set is generally greater than the thickness of the fiber set; however, this is not required. Typically, the width of at least one fiber set is at least about 0.5 mm, and more typically at least about 1 mm; however, other widths can be used. When a plurality of fiber sets are spaced apart from one another, the fiber sets are spaced at generally the same distance apart from one another; however, this is not required. Each set of fibers is generally formed of the same material; however, this is not required. As can be appreciated, each set of fibers can be formed of the type of material or same mixture of materials, however, this is not required. In yet another and/or additional aspect of the present invention, the reinforcement layer includes at least two fiber groups. The fiber groups can be laid in a parallel or non-parallel relationship to one another. The fibers in each group can be the same or different material. Each fiber set in each fiber group has generally the same number of fibers; however, this is not required. When two or more fiber groups are positioned in a non-parallel relationship to one another, one fiber group has an angular orientation to another fiber group of about 10-90°. In one non-limiting design of this aspect, the one fiber group is laid at least partially on another fiber group so as to form an angular orientation that is generally perpendicular. As can be appreciated, more than two fiber groups can be used to form the reinforced fabric. These fiber groups can be positioned parallel or non-parallel to one another.

In one non-limiting embodiment, the waterproof material can be a material that is easily heat welded together, thereby making durable and leak-proof seams and repairs.

Additives to enhance the properties of the polymer layer may also be used. Additives known to those skilled in the art include fire and flame retardants, colorants and pigments, ultraviolet absorbers and stabilizers, biocides, fillers, extenders, anti-oxidants, impact modifiers, etc.

The thickness of the waterproof material is generally at least about 10 mils and generally no more than about 300 mils (and all values and ranges therebetween). In one non-limiting embodiment of the invention, the waterproof material is at least about 30 mils (0.030"), typically at least about 40 mils (0.040"), and more typically about 40-80 mils (e.g., 45 mils, 55 mils, 60 mils, etc.). The thickness of the waterproof layer of the containment membrane according to one non-limiting aspect of the present invention can provide a strong, seamless barrier of protection for the purpose of preventing any spills from contaminating the ground below.

The thickness of the reinforcement layer is generally less than the thickness of the waterproof material; however, this is not required. In one non-limiting embodiment of the invention, the thickness of the reinforcement layer is at least about 2 mils and generally no more than about 50 mils (and all values and ranges therebetween). In one non-limiting aspect of the invention, the thickness of the reinforcement layer is at least 3 mils, typically at least 5 mils, and more typically about 5-25 mils. According to one non-limiting embodiment of the present invention, the waterproof layer constitutes at least 55% of the thickness of the overall containment membrane, typically at least 60% of the thickness of the overall containment membrane, and more typically at least 70% of the thickness of the overall containment membrane.

The polymer waterproof layer used in the containment membrane of the present invention can be resistant to oil degradation (e.g., Nitrile rubber, etc.); however, this is not required.

The top surface of the polymer waterproof layer can be textured with a slip-resistant surface. The textured pattern is non-limiting. The roughness average ($R_a$) in μm is at least 5 and typically less than 150 (and all values and ranges therebetween). In one non-limiting embodiment of the invention, the average ($R_a$) in μm is 15-80, typically 20-75, and more typically 30-70.

In other non-limiting embodiment, the top surface of the polymer waterproof layer can be a non-absorptive material such that it does not increase in weight when wet and does not absorb contaminants. Generally, the top surface of the polymer waterproof layer is liquid resistant. As such, the containment membrane can be easily cleaned if there is a spill of contaminants on the containment membrane.

In other non-limiting embodiment, the color of the polymer waterproof layer is non-limiting. However, in some non-limiting embodiments, a gray-colored polymer waterproof layer is used for the purpose of keeping the surface of the polymer waterproof layer cool and reducing surface level working temperatures in the heat of summer.

In other non-limiting embodiment, the breaking strength of the containment membrane is at least about 40 lbs. as tested per ASTM D 751 Procedure B, typically at least about 50 lbs. as tested per ASTM D 751 Procedure B, and more typically about 55-250 lbs. (and all values and ranges therebetween). In other non-limiting embodiment, the containment membrane has an elongation of at least about 25% when tested per ASTM D 751, typically at least about 30% when tested per ASTM D 751, and more typically at least about 35-80% (and all values and ranges therebetween) when tested per ASTM D 751. In other non-limiting embodiment, the containment membrane experiences less than about 8% loss of mass due to exposure to common chemicals found in the oil and gas environment when tested per ASTM D 5747, typically less than about 5% loss of mass due to exposure to common chemicals found in the oil and gas environment when tested per ASTM D 5747, and more typically less than about 2% loss of mass due to exposure to common chemicals found in the oil and gas environment when tested per ASTM D 5747. In other non-limiting embodiment, the containment membrane has a low temperature flexibility of at least −10° F. when tested by ASTM D 2136-02 without compromising the containment material, typically the containment membrane has a low temperature flexibility of at least −20° F. when tested by ASTM D 2136-02 without compromising the containment material, and more typically the containment membrane has a low temperature flexibility of at least −30° F. when tested by ASTM D 2136-02 without compromising the containment material. In other non-limiting embodiment, the containment membrane resists tearing at a force of at least 10 lbf. as measured per ASTM D 751, typically the containment membrane resists tearing at force of at least 15 lbf. as measured per ASTM D 751, and more typically the containment membrane resists tearing at force of at least 25 lbf. as measured per ASTM D 751. In other non-limiting embodiment, the containment membrane provides resistance to abrasion such that the containment membrane does not experience penetration of the waterproofing layer when it experiences at least 200 abrasion cycles per ASTM D 3389—Method B, typically the containment membrane does not experience penetration of the waterproofing layer when it experiences at least 500 abrasion cycles per ASTM D 3389—Method B, and more typically the containment membrane does not experience penetration of the waterproofing layer when it experiences at least 1000 abrasion cycles per ASTM D 3389—Method B.

In other non-limiting embodiment, two overlapping layers of the containment membrane are connected together such that the seam strength is at least about 50 lbf. before the watertight integrity of the seam is compromised per ASTM D 751, typically at least about 100 lbf. before the watertight integrity of the seam is compromised per ASTM D 751, and more typically at least about 200 lbf. before the watertight integrity of the seam is compromised per ASTM D 751. In another non-limiting embodiment, the seam can be a heat created melted seam formed by heating the overlapped regions of the containment member to cause the polymer waterproof layer of one layer of the containment member to bond with the polymer waterproof layer from the other layer of containment member during the heat welding process. As can be appreciated, the seam can also or alternatively be formed by an adhesive.

The containment membrane also includes a reinforcement material layer connected to the bottom surface of the polymer waterproof layer. The reinforcement layer can be applied to the polymer waterproof layer by conventional processes known in the rubber and/or plastic arts resulting in a containment membrane which, while highly flexible, is impervious to the flow of liquid therethrough. In use, the reinforcement layer provides the containment membrane with increased puncture resistance from below without the need for additional material installation.

The type of reinforcement material is non-limiting. The reinforcement material can be a fabric material; however, this is not required. The fabric material can be a woven or non-woven fabric material. In embodiments, the reinforcement material is a woven polyester fabric.

Both the polymer waterproof layer and the fabric material can have a composition and thickness to enable the containment membrane to be flexible. The polymer waterproof layer can optionally be poured in liquid form or extruded in a heated state onto the fabric layer, however, it can be appreciated that other or additional means can be used to secure the polymer waterproof layer to the fabric layer (e.g., melted bond, stitching, adhesive, fabric layer dipping process, etc.).

The containment membrane can be formed or cut to form a predetermined width (e.g., 1-20 ft., 6 ft., etc.) and length (e.g., 1-200 ft, 24 ft., etc.) of containment membrane strips which can optionally be rolled and packaged for transportation and use at the site where the containment membrane is to be installed.

The containment membrane of the present invention can be in a rolled form that is unrolled when applied at a site. The containment membrane strips can be easily connected together (e.g., heat welded, adhesively bonded, etc.) at overlapping/underlapping edges to provide a durable, leakproof seam between adjacent containment membrane strips.

In use, the unique composition of the containment membrane of the present invention provides increased puncture resistance from above and below the surface along with flexibility. As such, the containment membrane can be flexible without reducing strength. The containment membrane of the present invention is capable of withstanding heavy equipment typically found in the fracking industry.

The unique structure of the containment membrane according to one non-limiting aspect of the present invention permit use in high and low temperatures. As such, the containment membrane's flexibility and waterproofing capabilities are not compromised by low temperatures (e.g., 0-30° F.) to temperatures as high as 200° F. Because the containment membrane of the present invention maintains flexibility and waterproof capabilities in cold temperatures, the installation process is much easier and faster than with stiffer materials.

According to one non-limiting embodiment of the present invention, the containment membrane has nearly the same tensile strength in all directions and can therefore withstand large deformation and possesses excellent puncture resistance while maintaining an impermeable state.

The containment membrane can be laid down in strip form as aforementioned, from rolls of containment membrane material thereby covering the ground to be protected with a plurality of such containment membrane strips. The containment membrane strips are aligned in an overlapping/underlapping orientation for providing a containment membrane sheet of any desired size. The overlapping sections of the containment membrane are fixed together at the overlapping/underlapping seam by suitable means, which can be applied at the site, so there is no chance for liquid to seep through between the junctions and escape from the containment perimeter into the surrounding ground area.

The containment membrane of the present invention can be wrapped over berms or curbs so as to provide a dimensional height so that spills and rainwater is retained within the containment perimeter. The site upon which lies the containment membrane can be sloped to internal drains which are used to capture the rainwater, any petroleum spills, contaminants, etc. that spill onto the containment membrane. Any fluid can be analyzed prior to pumping out the drains for disposition.

The containment membrane can be durable and flexible such that when heavy equipment drives over the containment membrane, the containment membrane as well as the berms or curbs (which can also be wrapped by the containment membrane) retain their original structure.

Rig mats can be used in conjunction with the containment membrane of the present invention. The rig mats can be composed of one-piece compression molded plastic material that will not crush or compress when subjected to loads typical of an oil and gas drilling and production site. The rig mats can optionally have an interlocking mechanism to connect multiple rig mats together such that slippage and separation of the rig mats can be reduced or prevented. The rig mats can optionally be connected to a top surface of the containment membrane by an adhesive, melted seam, or some other means.

In protecting an area of ground in a worksite, foam berms or curb portions can be placed on the top surface at or near the peripheral edge of the containment membrane sheet to define the containment area. The containment membrane can be enveloped (e.g., wrapped, etc.) around the foam berm or curb portion material. The overlapping section of inverted containment membrane can be fixed to the base containment membrane by various means as previously discussed.

The unique structure of the containment membrane of the present invention permits easy and convenient puncture repair. In a field of containment membrane, a method of puncture repair can comprise: cutting a piece of containment membrane for patching; extending the containment membrane patch to an area greater on all sides than the size of the hole to be repaired; cleaning and drying the area where said membrane patch is to be installed; and, connecting the patch material (e.g., melted seam, adhesive seam, etc.) on all sides to form a liquid proof seam. In one non-limiting embodiment, the containment membrane patch should extend at least about 2-10 inches (e.g., 4 inches) over the containment membrane puncture on all sides of the puncture so that the formed seam is at least two inches about the complete perimeter of the region to be repaired. The repair material for the field of the containment membrane can be a piece of material identical to the containment membrane. For temporary repair, the material used of the containment membrane should be durable enough to survive at least about 24 hours, typically at least about 36 hours, and more typically about 36-60 hours (e.g., 48 hours).

The containment membrane of the present invention is unique in a number of ways. The thicker, textured polymer waterproof layer provides durability while offering a non-absorptive, slip-resistant layer. Additionally, the containment membrane does not need to be removed between drilling and fracking operations. Also, because there is not a fabric layer on the topside of the containment membrane, the containment membrane can be easily and conveniently cleaned and repaired when needed (which improves longevity of the containment membrane) and which does not adsorb liquid, contaminants, etc.

According to one non-limiting aspect of the present invention, there is provided a method of protecting an area of ground at a worksite that includes the step of using a containment membrane material that is capable of preventing contaminants from seeping therethrough. The ground to be protected is covered with strips of the containment membrane. The strips are aligned in an overlapping side-by-side fashion. The adjacent containment membrane strips are then connected together to create a liquid-proof seam therebetween. Berms or curb portions can optionally be placed on the top surface of the containment membrane at or near the peripheral edge of the containment membrane. The berms or curb portions can be connected to the containment membrane by various means. One non-limiting arrangement to connect the berms or curb portions to the containment membrane is to wrap the berm or curb portion with the containment membrane. The berms or curb portions can be used to define a containment perimeter around the worksite to be protected. The material used to form the berm or curb portion is non-limiting. One non-limiting material is a foam material. Another non-limiting material is a material that is compressible when a compression force is applied to the material (e.g., stepped upon by a human, rolled over by a vehicle, etc.) and which also regains its original shape after the compression force is removed. Non-limiting compressible materials that can be used include high-density polystyrene foam, high-density polyurethane foam, neoprene foam, and closed-cell polyethylene foam. One such non-limiting material is a high-density foam that has the ability to return to form and shape when compressed for a brief period of time by heavy loading. The shape of the berm or curb portion is also non-limiting. Non-limiting shapes of the berm or curb portion are materials having a cross-sectional shape of a triangle, circle, half-circle, oval, polygonal shape, etc. The containment membrane can be optionally connected to the berm or curb portion by various means (e.g., adhesive, melted connection, mechanical connection, hook and loop fastener, etc.). When the portion of the containment membrane is used to cover a berm or curb portion to secure the berm or curb portion in position, the overlapped portions of the containment can be by any means (e.g., adhesive, melted connection, mechanical connection, hook and loop fastener, rivet, clamp, etc.). The height of the berm or curb portion about which the containment perimeter is defined is non-limiting. In one non-limiting arrangement, the height of the berm or curb portion is about 1-15 inches (and all values and ranges therebetween), and typically 2-8 inches.

The method of forming the containment membrane and the structure of the containment membrane itself results in an economical yet effective containment system for catching and reclaiming liquids and preventing their passage into adjacent land areas and, therefore, into rivers and streams which results in pollution of groundwater and other public waterways.

One non-limiting object of the invention is the provision of an improved containment membrane that is liquid-resistant, durable, has a slip-resistant top surface, is a flexible membrane (which top portion of the containment membrane does not absorb liquids), and is easy to install and use.

Another and/or alternative non-limiting object of the invention is the provision of an improved containment membrane that is durable enough to remain in place during the drilling and fracking phases to eliminate the delay and cost of replacement.

Another and/or alternative non-limiting object of the invention is the provision of an improved containment membrane that can be easily and conveniently relocated from site to site.

Another and/or alternative non-limiting object of the invention is the provision of an improved containment membrane that can be used in conjunction with a berm or curb portion thereby defining a space or pit opening upwardly and encompassing the general containment area.

Another and/or alternative non-limiting object of the invention is the provision of an improved containment membrane that comprises a first layer and a second layer, wherein the first layer can be a polymer waterproof layer and the second layer can be a reinforcement layer.

Another and/or alternative non-limiting object of the invention is the provision of an improved containment membrane wherein the polymer waterproof layer can be a high-density polyethylene (HDPE) plastic, a low-density polyethylene (LDPE) plastic, a rubber material, polyvinyl chloride (PVC), various types of resins, various types of resin epoxies, polyester, polypropylene, polyurethane, polyacrylate, and copolymers thereof, etc., and the reinforcement layer can be a fabric material.

Another and/or alternative non-limiting object of the invention is the provision of an improved containment membrane wherein the reinforcement layer can be connected to a bottom side of a waterproof layer and wherein the top surface of the polymer waterproof layer is absent the fabric layer.

Another and/or alternative non-limiting object of the invention is the provision of an improved containment membrane wherein at least a portion of the fabric layer is impregnated with the polymer waterproof layer to form the containment membrane.

Another and/or alternative non-limiting object of the invention is the provision of an improved containment membrane that includes a waterproof material that can be easily heat welded together thereby making liquid-proof seams and/or repairs.

Another and/or alternative non-limiting object of the invention is the provision of an improved containment membrane having reinforcement layer that is generally less than the thickness of the waterproof material.

Another and/or alternative non-limiting object of the invention is the provision of an improved containment membrane that is resistant to oil degradation.

Another and/or alternative non-limiting object of the invention is the provision of an improved containment membrane having a top surface that is textured with a slip-resistant surface.

Another and/or alternative non-limiting object of the invention is the provision of an improved containment membrane wherein the top surface of the polymer waterproof layer is a non-absorptive material such that it does not increase in weight when wet and does not absorb contaminants.

Another and/or alternative non-limiting object of the invention is the provision of an improved containment membrane wherein the top surface of the polymer waterproof layer is liquid resistant.

Another and/or alternative non-limiting object of the invention is the provision of an improved containment membrane that can be easily cleaned if there is a spill of contaminants on the containment membrane.

Another and/or alternative non-limiting object of the invention is the provision of an improved containment membrane wherein the surface of the polymer waterproof has a cool that facilitates in reducing surface level working temperatures in the heat of summer.

Another and/or alternative non-limiting object of the invention is the provision of an improved containment membrane wherein the breaking strength of the containment membrane is at least about 40 lbs. as tested per ASTM D 751 Procedure B.

Another and/or alternative non-limiting object of the invention is the provision of an improved containment membrane wherein an elongation of the containment membrane is at least about 25% when tested per ASTM D 751.

Another and/or alternative non-limiting object of the invention is the provision of an improved containment membrane wherein the containment membrane experiences less than about 8% loss of mass due to exposure to common chemicals found in the oil and gas environment when tested per ASTM D 5747.

Another and/or alternative non-limiting object of the invention is the provision of an improved containment membrane wherein the containment membrane has a low temperature flexibility of at least −10° F. when tested by ASTM D 2136-02 without compromising the containment material.

Another and/or alternative non-limiting object of the invention is the provision of an improved containment membrane wherein the containment membrane resists tearing at force of at least 10 lbf. as measured per ASTM D 751.

Another and/or alternative non-limiting object of the invention is the provision of an improved containment membrane wherein the containment membrane provides resistance to abrasion such that the containment membrane does not experience penetration of the waterproofing layer when it experiences at least 200 abrasion cycles per ASTM D 3389—Method B.

Another and/or alternative non-limiting object of the invention is the provision of an improved containment membrane wherein two overlapping layers of the containment membrane are connected together such that the seam strength is at least about 50 lbf. before the watertight integrity of the seam is compromised per ASTM D 751.

Another and/or alternative non-limiting object of the invention is the provision of an improved containment membrane wherein a seam that is used to connect overlapping portions of two strips of containment membrane is a heat-created melted seam formed by heating the overlapped regions of the containment member to cause the polymer waterproof layer of one layer of the containment member to bond with the polymer waterproof layer from the other layer of containment member during the heat welding process.

Another and/or alternative non-limiting object of the invention is the provision of an improved containment membrane wherein a seam that is used to connect overlapping portions of two strips of containment membrane is formed by an adhesive.

Another and/or alternative non-limiting object of the invention is the provision of an improved containment membrane that can be in a rolled form that is unrolled when applied at a site.

Another and/or alternative non-limiting object of the invention is the provision of an improved containment membrane that provides increased puncture resistance from above and below the surface along with flexibility.

Another and/or alternative non-limiting object of the invention is the provision of an improved containment membrane wherein the containment membrane can be laid down in strip form from rolls of containment membrane material thereby covering the ground to be protected with a plurality of such containment membrane strips, and wherein the containment membrane strips are aligned in an overlapping/underlapping orientation for providing a containment membrane sheet of any desired size, and wherein the overlapping sections of the containment membrane are fixed together at the overlapping/underlapping seam by suitable means, which can be applied at the site, so there is no chance for liquid to seep through between the junctions and escape from the containment perimeter into the surrounding ground area.

Another and/or alternative non-limiting object of the invention is the provision of an improved containment membrane wherein the containment membrane can be wrapped over berms or curbs so as to provide a dimensional height, retaining spills and rainwater within the containment perimeter.

Another and/or alternative non-limiting object of the invention is the provision of an improved containment membrane wherein the containment membrane can be sloped to internal drains which are used to capture the rainwater, any petroleum spills, contaminants, etc. that spill onto the containment membrane.

Another and/or alternative non-limiting object of the invention is the provision of an improved containment membrane wherein the containment membrane is durable and flexible such that when heavy equipment drives over the containment membrane, as well as the curbs (which can also be wrapped by the containment membrane), the containment membrane and the curbs retain their original structure.

Another and/or alternative non-limiting object of the invention is the provision of an improved containment membrane wherein rig mats can be used in conjunction with the containment membrane, wherein the rig mats can be composed of one piece compression molded plastic material that will not crush or compress when subjected to loads typical of an oil and gas drilling and production site.

Another and/or alternative non-limiting object of the invention is the provision of an improved containment membrane that permits easy and convenient puncture repair.

These and other objects, features, and advantages of the present invention will become apparent from the subsequent description taken in conjunction with the accompanying drawings.

BRIEF DESCRIPTION OF THE DRAWINGS

Reference may now be made to the drawings, which illustrate various embodiments that the invention may take in physical form and in certain parts and arrangements of parts wherein.

DETAILED DESCRIPTION OF NON-LIMITING EMBODIMENTS

An exemplary non-limiting embodiment of the present invention includes a liquid-resistant membrane, suitable for use as a containment membrane in various types of application. One non-limiting application is in the fracking industry and the use of the containment membrane will be described with particular reference for use in fracking applications; however, it will be appreciated that the containment membrane can be used in many other applications where it is desirable to contain liquids, contaminants and the like.

Figure 1:
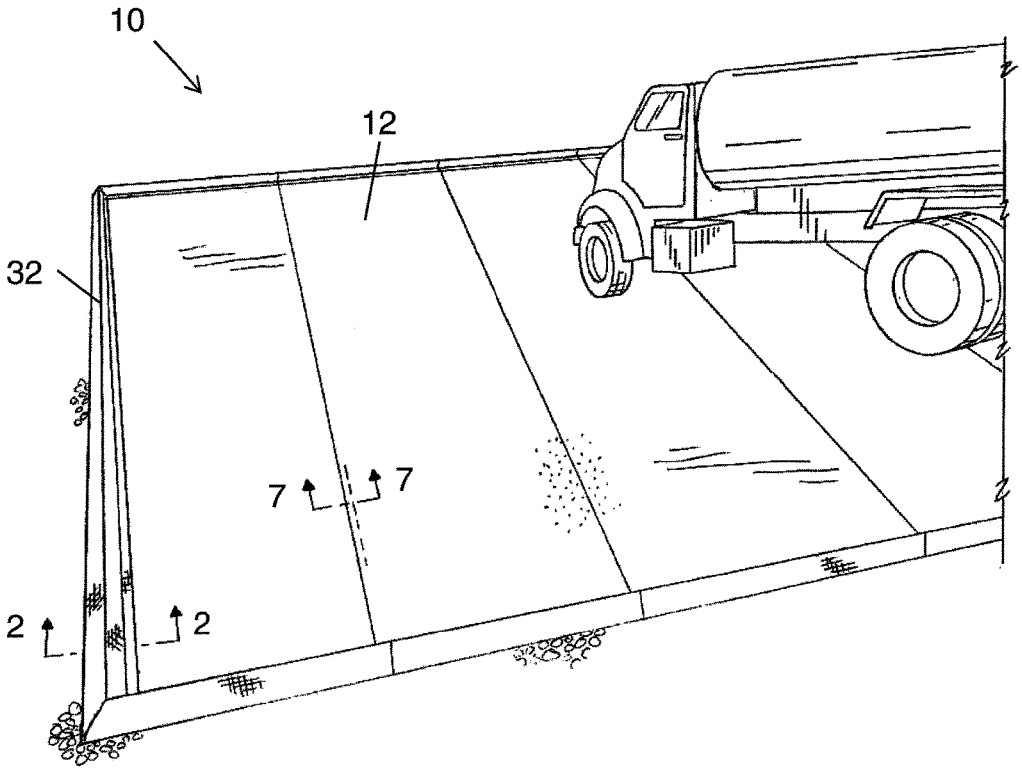
FIG. 1 is a perspective illustration of a containment membrane according to one non-limiting aspect of the present invention in use at a site such as for example an oil fracking site.
Figure 7:
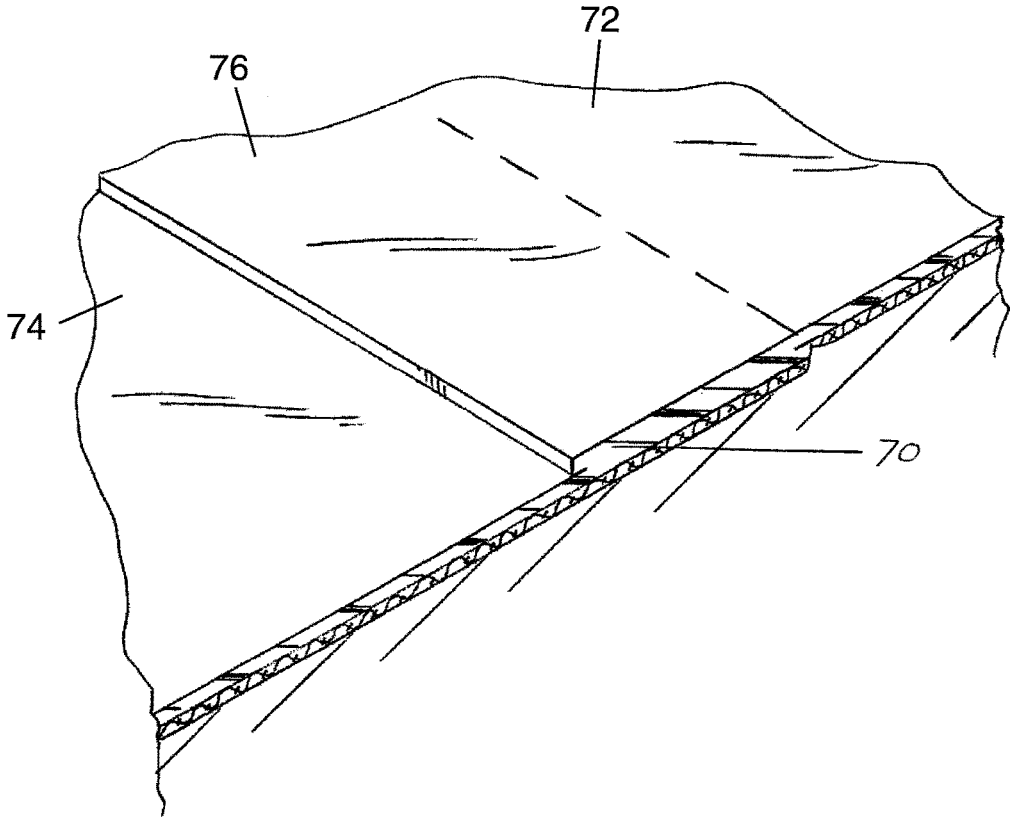

Referring now to FIG. 1, an oil fracking site or other fluid containment area 10 is bound by a containment system that is formed by a plurality of strips of containment membrane 12 that are connected together at a seam 70 (as best illustrated in FIG. 7). As will be described in more detail below, seam 70 is typically a liquid-proof or liquid-resistant seam. The containment membrane is a waterproof membrane that is a configured to form a containment system to prevent a liquid spill (not shown) from seeping into the ground. The containment membrane is also durable to resist tearing and other types of damage when large vehicle and humans move over the surface of the containment membrane. A curb 32 can be formed in the containment system to create an outer raised perimeter in the containment system to facilitate in maintaining spilled liquids in the containment system. The curb can be formed about the complete perimeter of the containment system or on a portion of the containment system.

One non-limiting method for installing the containment system at a particular site is as follows:

1. Verify that the site wherein the containment system is to be installed is ready to receive the containment system. For example, the site should be cleared of vehicles, equipment, vegetation, etc. that would interfere with the installation of the containment system at the site.

2. Verify that the containment site is relatively smooth and free of depressions, sharp projections and that the site is sloped properly to allow drainage to the designated drainage areas.

3. Lay one or more strips of containment membrane on the surface of the site. The containment membrane can be provided in rolls, thereby allowing each strip of containment member to be rolled out on the site. The textured top surface of the containment membrane should be facing upwardly from the ground surface of the site. When two or more strips of containment membrane are laid in the site, the side edges of adjacently positioned strips of containment membrane are overlapped with one another. The amount of overlap is generally 1-10 inches (an all values and ranges therebetween), typically 2-8 inches, and more typically 3-6 inches (e.g., 4 inches). As such, when the seam is formed between the overlapped strips, the width of the seam is generally at least 1 inch and typically 1-10 inches.

4. Form a liquid-proof or liquid-resistant seam 70 between the overlapped edges of adjacently positioned containment membranes. The liquid-proof or liquid-resistant seam is typically formed by use an adhesive or by forming a melted seam. Prior to forming the seam, it is desirable to remove any moisture that may be present in the area of the seam to be formed. Also, the area to be seamed should be cleaned of dirt, debris or other foreign materials that could adversely affect the formation of the seam. When a melted seam is to be formed, such seam can be formed by a heated iron or by hot air welding. The hot air welder should be operated at the proper air temperature and speed to ensure a continuous waterproof weld along the entire seam between two adjacent containment membrane strips. The hot air welded seam should be free of fish mouths or otherwise areas void. The adjacent containment membrane strips should be overlapped while being hot air welded such that water moves over the lapped joint in a shingle fashion to prevent water being trapped in the seam area. The seam strength is generally at least about 60 lbf. before the water-tight integrity of the seam is compromised per ASTM D 751.

A curb can also be installed around the complete perimeter or a portion of the perimeter of the containment system. One non-limiting method for installing the curb is as follows:

1. Position a berm or curb at or near the perimeter of the containment system.

2. Secure the berm or curb to the containment membrane. The berm or curb can be secured to the containment membrane by an adhesive, melted seam, or some other means. Alternatively, a portion of the containment member can be folded back over the berm or curb and the edge of the folded back portion can then be secured to the top surface of the containment membrane by use of a connection arrangement 24 form by an adhesive, melted seam, or some other means.

In the event that the containment membrane is torn or otherwise damaged, a patch can be placed over the damaged area. Generally, the patch is formed of the same material as the containment membrane. The area to be patched is generally cleaned so that the patch can be properly secured over the damaged area. The connection between the patch and the damaged containment membrane is generally a liquid-proof or liquid-resistant seam. Such a seam can be formed by an adhesive, a melted sea, or some other means.

Figure 2:
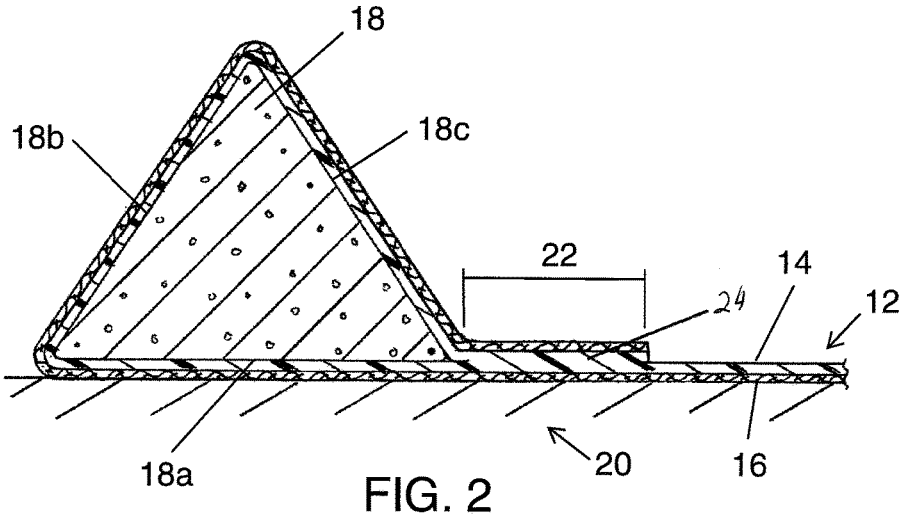
FIG. 2 is a cross-sectional view of the curb detail taken from line 2-2 of FIG. 1.
Figure 4:
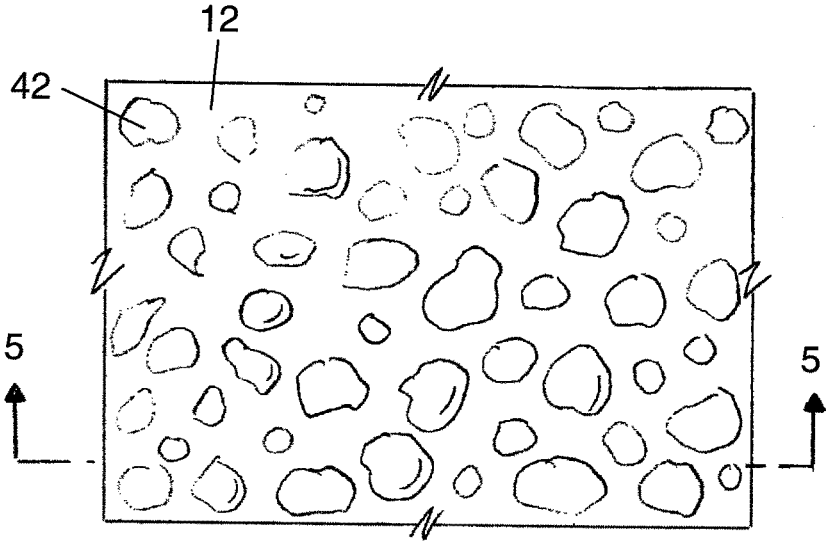
FIG. 4 is a top-view perspective illustration demonstrating the textured surface of the top surface of the polymer waterproof layer.
Figure 5:
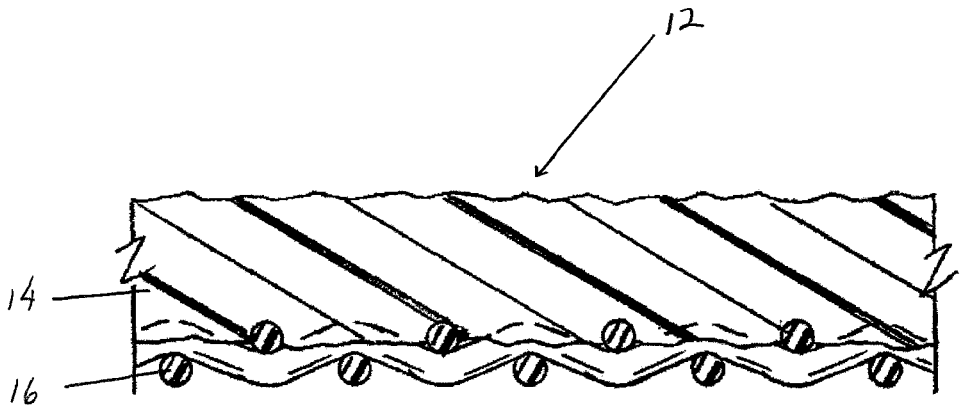
FIG. 5 is a cross-sectional view taken from line 5-5 of FIG. 4.

Referring now to FIGS. 2 and 4-6, the containment membrane 12 is formed of a first layer 14 and a second layer 16 (see FIGS. 2 and 5). The first layer is a polymer waterproof layer. The second layer is a reinforcement material.

As illustrated in FIG. 4, the top surface of the polymer waterproof layer 14 is textured with a plurality of slip-resistant surface projections, one of which is indicated as 42 for the purpose of improving foot traction when wet. The textured pattern in the top surface of the polymer waterproof layer is non-limiting.

The polymer waterproof layer can be a high-density polyethylene (HDPE) plastic, a low-density polyethylene (LDPE) plastic, a rubber material, polyvinyl chloride (PVC), various types of resins, various types of resin epoxies, polyester, polypropylene, polyurethane, polyacrylate, and copolymers thereof, etc. Additives to enhance the properties of the polymer waterproof layer may also be used (e.g., fire and flame retardants, colorants and pigments, ultraviolet absorbers and stabilizers, biocides, fillers, extenders, anti-oxidants, impact modifiers, etc.). The thickness of the polymer waterproof layer is generally about 30-80 mils. The reinforcement layer is illustrated as a woven fabric material. The reinforcement layer is connected to a bottom side of the polymer waterproof layer. As illustrated in FIG. 5, the top surface of the polymer waterproof layer is absent the reinforcement layer. The texture of the reinforcement layer can generally be felt or visually seen in the bottom of the containment membrane as is illustrated in FIG. 5, but generally cannot be felt on the top of the polymer waterproof layer. The reinforcement layer is generally fully coated with the polymer waterproof layer; however, this is not required. The reinforcement layer is illustrated as being formed by a plurality of woven fibers, non-woven fibers or some mixtures thereof. The reinforcement layer may or may not include any stitching of the fibers. The fibers can include materials such as, but not limited to, glass fibers (e.g., silica glass, aramid glass, etc.), carbon fibers, quartz fibers, Kevlar® fibers, boron fibers, polyethylene fibers, polyamide fibers, polypropylene fibers, etc. The thickness of the reinforcement layer is generally less than the thickness of the polymer waterproof layer. The thickness of the reinforcement layer is generally 4-20 mils. The polymer waterproof layer generally constitutes 70-98% of the thickness of the overall containment membrane.

The containment membrane can be formed by a variety of processes (e.g., at least a portion of the reinforcement layer is impregnated with the polymer waterproof layer to form the containment membrane, the polymer waterproof layer is applied to the reinforcement layer by a dipping process and/or a spray coating process, the polymer waterproof layer is heated and the reinforcement layer is pressed into the heated polymer waterproof layer, etc.).

The containment membrane is configured to be a flexible, waterproof and durable membrane. The breaking strength of the containment membrane is typically about 55-100 lbs. as tested per ASTM D 751 Procedure B. The containment membrane typically has an elongation of about 35-70% when tested per ASTM D 751. The containment membrane typically experiences less than about 4% loss of mass due to exposure to common chemicals found in the oil and gas environment when tested per ASTM D 5747. The containment membrane has a low temperature flexibility of at least −10° F. when tested by ASTM D 2136-02 without compromising the containment material. The containment membrane resists tearing at force of at least 20 lbf. as measured per ASTM D 751. The containment membrane provides resistance to abrasion such that the containment membrane does not experience penetration of the waterproofing layer when it experiences at least 400 abrasion cycles per ASTM D 3389—Method B.

The containment membrane can be formed or cut to form a predetermined width (e.g., 1-20 ft., 6 ft., etc.) and length (e.g., 1-200 ft, 24 ft., etc.) of containment membrane strips which can be rolled and packaged. Generally, the containment membrane has nearly the same tensile strength in all directions and can therefore withstand large deformation, and possesses excellent puncture resistance, while maintaining an impermeable state.

FIG. 5 is a cross-sectional perspective illustration taken along line 5-5 of FIG. 4 demonstrating the woven pattern of the reinforcement layer 16.

Figure 6:
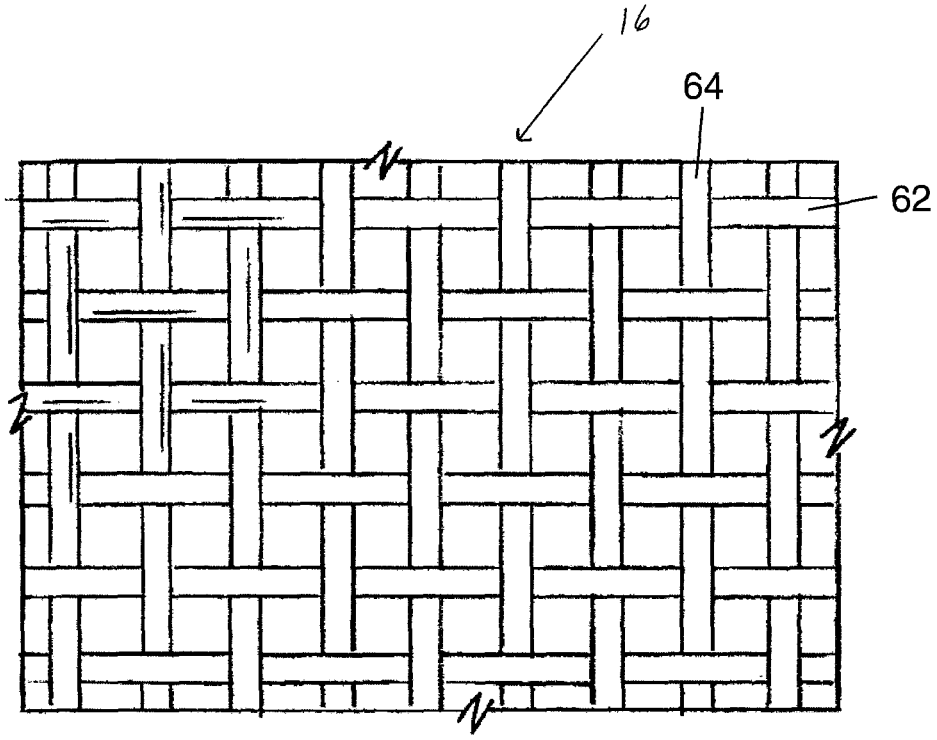
FIG. 6 is a top plan view of the reinforcement material used in the containment membrane; and, FIG. 7 is a cross-sectional view taken from line 7-7 of FIG. 1.

FIG. 6 is a perspective illustration demonstrating the woven pattern of the reinforcement layer 16 according to one non-limiting aspect of the present invention. The woven material pattern comprises a longitudinal thread system 62 and a transverse thread system 64. The transverse thread system is woven together with the longitudinal thread system in an interlaced fashion. Thread system 62, 64 can be stitched together, adhesively bonded together, or include melted bonding prior to the reinforcement layer being connected to the polymer waterproof layer; however, this is not required.

EXAMPLES

The following examples are provided to illustrate in detail the materials, methods and techniques of this invention.

These examples are illustrative only, and are not intended to limit the application of the present invention.

The thickness of the containment membrane of Example 1 and Example 2 was tested according to ASTM D 1777, Standard Test Method for Thickness of Textile Materials. Breaking strength of the containment membrane of Example 1 and Example 2 was tested according to ASTM D 751 Procedure B, Standard Test Method for Coated Fabrics. Low temperature flexibility of the containment membrane of Example 1 and Example 2 was tested according to ASTM D 2136-02, Standard Test Method for Coated Fabrics—Low Temperature Bend Test. Elongation, tearing strength and seam strength of the containment membrane of Example 1 and Example 2 were tested according to ASTM D 751, Standard Test Method for Coated Fabrics. Abrasion resistance of the containment membrane of Example 1 and Example 2 was tested according to ASTM D 3389 Method B, Standard Test Method for Coated Fabrics Abrasion Resistance.

Example 1

In this example, a reinforcement layer was adhered to a flexible polymer waterproof layer. The reinforcement layer was 5 mils (0.005") thick and made of polyester. The polymer waterproof layer was 50 mils (0.050") thick and was made from polyvinyl chloride (PVC). The containment membrane was tested for its physical properties listed in Table 1.

Example 2

In this example, a fleece-backed material layer was adhered to a flexible polymer waterproof layer. The fleece-backed layer was 10 mils (0.010") thick and made of woven fleece. The polymer waterproof layer was 50 mils (0.050") thick and made from polyvinyl chloride (PVC). The containment membrane was tested for its physical properties listed in Table 1.

TABLE 1

| Property | Test Procedure | Example 1 | Example 2 |
|---|---|---|---|
| Thickness (mils) | ASTM D 1777 | 55 | 60 |
| Breaking Strength (lbs.) | ASTM D 751 Procedure B | 130 | 65 |
| Elongation (%) | ASTM D 751 | 50 | 50 |
| Low Temperature Flexibility (° F.) | ASTM D 2136-02 | −30 | −30 |
| Tearing Strength (lbf) | ASTM D 751 | 40 | 25 |
| Seam Strength (lbf) | ASTM D 751 | 250 | 250 |
| Abrasion Resistance (number of cycles) | ASTM D 3389 - Method B | 1000 | 1000 |

The examples described herein are not intended to limit the scope of the invention generally disclosed.

Figure 3:
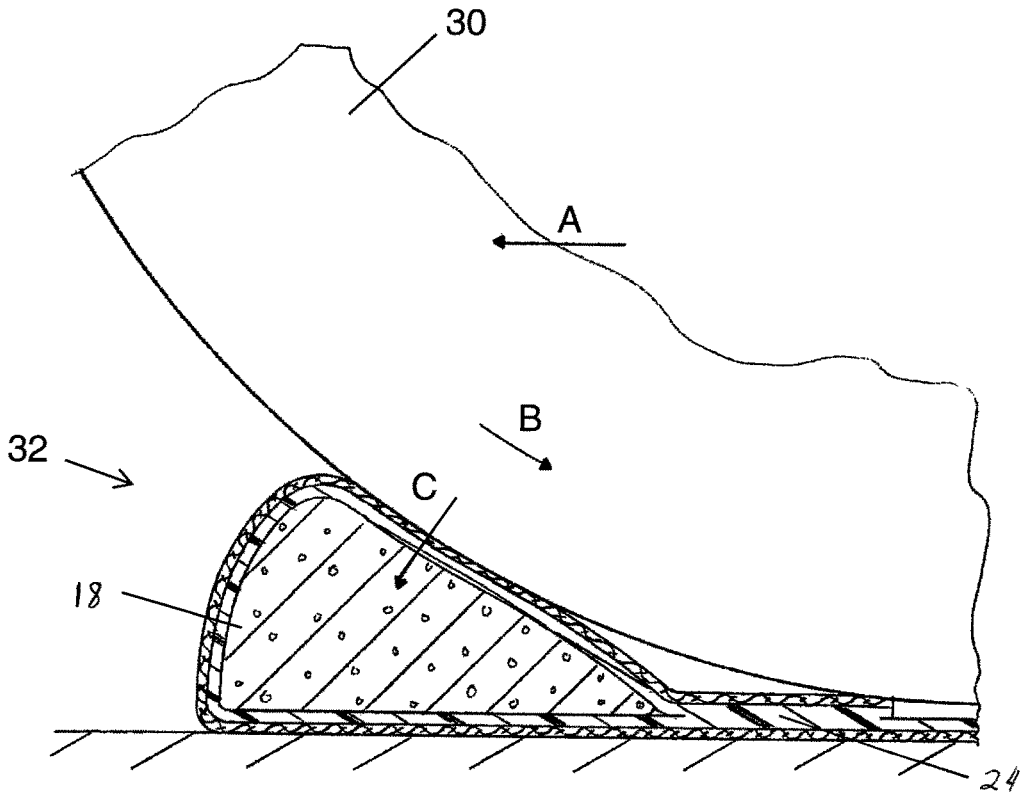
FIG. 3 is a cross-sectional view of the curb detail demonstrating a vehicle moving over said curb.

Referring now to FIGS. 1-3, a curb 32 can be formed in the containment system. As illustrated in FIG. 2, the containment membrane can be wrapped over a berm or curb 18 so as to provide a dimensional height so that spills and rainwater are retained within the containment perimeter of the containment system. The site upon which the containment membrane lies can be sloped to internal drains which are used to capture the rainwater, any petroleum spills, contaminants, etc. that spill onto the containment membrane. Any fluid can be analyzed prior to pumping out the drains for disposition.

The walls created by the containment membrane and foam berm material can comprise generally vertically-oriented walls which merge continuously with the containment membrane thereby creating a leak-proof containment membrane perimeter.

FIG. 2 is a cross-sectional perspective illustration of a containment membrane curb installation. Generally, containment membrane 12 is laid upon a ground material 20 such that the reinforcement material 16 on the bottom side of the containment membrane is in direct contact with the ground material 20. As such, the polymer waterproof layer on the top side of the containment membrane faces upwardly. A foam berm material 18 is placed upon the top surface of the polymer waterproof layer 14 of containment membrane 12 such that the bottom surface 18*a* of foam berm material 18 engages directly with the polymer waterproof layer 14. Containment membrane 12 is enveloped (e.g., wrapped) around the foam berm material 18 such that the polymer waterproof layer engages with foam berm edges 18*b* and 18*c* and such that the inverted portion 22 containment membrane 12 extends at least partially over the base containment membrane. As such, the reinforcement material layer 16 is exposed outwardly from the foam berm material 18 on sides 18*b* and 18*c* and along the upwardly-facing surface of the inverted portion 22 of containment membrane 12. A connection arrangement 24 such as melted seam is used to connect the polymer waterproof layers of containment membrane 12. The width of the overlapping inverted portion 22 is generally about 2-8 inches (e.g., 4 inches). As such, when the seam is formed between the overlapping inverted portion and the top surface of the containment membrane, the width of the seam is generally at least 1 inch and typically 2-8 inches.

FIG. 3 is a perspective illustration demonstrating a vehicle moving over a containment membrane curb. The vehicle (not shown) is traveling in the direction indicated by arrow "A" such that its wheels are spinning counter-clockwise, the direction indicated by arrow "B." As such, when a tire 30 approaches and engages with containment curb 32, oblique forces are generated on containment curb 32 as indicated by arrow "C". Foam berm material 18 can retain its original configuration once the vehicle passes over and the forces are released off of containment curb 32.

According to one non-limiting aspect of the present invention, the foam berm material allows for different applied forces. The foam material may compress, but is resilient and returns to its original shape when no force is applied. The foam material can be a high-density foam that has the ability to return its form and shape when compressed by heavy loading.

The containment membrane can be durable and flexible such that when heavy equipment drives over the containment membrane, as well as the berms or curbs (which can also be wrapped by the containment membrane) the containment membrane and berms or curbs retain their original structure.

With reference to FIG. 7, an overlapping containment membrane strip 72 can be joined with an underlapping containment membrane strip 74 at seam 76. Seaming techniques can include use of an adhesive, heat welding and other techniques. The width of the seam is at least about 1 inch, typically at least about 2 inches, and more typically about 2-6 inches (e.g., 4 inches). During seaming, the containment membrane strips are placed reinforcement layer down. The polymer waterproof layer of the overlapping layer can be heat welded directly to the polymer waterproof layer of the underlapping layer.

With continued reference to FIG. 7, underlapping containment membrane layer 74 is joined continuously with overlapping containment membrane layer 72 at seam 76. As such, no cavity or space is formed between the pair of underlapping and overlapping strips.

It will this be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as the come within the scope of the present invention. It is also to be understood that the following claims are intended to cover all of the generic and specific features of the intention herein described and all statements of the scope of the invention, which, as a matter of language, might be said to fall therebetween.

What is claimed:

1. A method for protecting an area of ground in a worksite by forming a containment system comprising the steps of:

providing a plurality of strips of a liquid-proof containment membrane capable of blocking contaminants from seeping therethrough, each strip of said containment membrane having a top and bottom surface and comprising a polymer waterproof layer forming said top surface of said container membrane and a reinforcement layer that is at least partially embedded in said polymer waterproof layer, said reinforcement layer positioned below said top surface of said containment membrane, said polymer waterproof layer has a thickness that is greater than a thickness of said reinforcement layer, said top surface of said polymer waterproof layer having a textured surface to form a non-smooth surface to form a slip-resistant top surface for improving foot traction when wet;

arranging said plurality of strips of containment membrane on the worksite to cover a top surface of the worksite and to cause adjacently positioned strips of said containment membrane to overlap at a side edge of each of said adjacently positioned strips of said containment membrane, said bottom surface of each strip of containment membrane facing said top surface of the worksite; and, forming a liquid-proof or liquid-resistant heat-created melted seam or a liquid-proof or liquid-resistant adhesive bond between said overlapped side edges of said adjacently positioned strips of said containment membrane to form said containment system on said worksite.

2. The method as defined in claim 1, wherein said reinforcement layer is a woven fabric material.

3. The method as defined in claim 2, wherein said polymer waterproof layer has a thickness of about 40 to about 80 mils, said reinforcement layer has a thickness of about 10 to about 15 mils.

4. The method as defined in claim 2, wherein said polymer waterproof layer is greater than 70% of a thickness of said containment membrane.

5. The method as defined in claim 1, wherein said polymer waterproof layer includes polyvinyl chloride, said reinforcement layer comprising a fabric of woven fibers.

6. The method as defined in claim 1, wherein said textured surface has a $R_a$ of at least 20 μm.

7. The method as defined in claim 1, wherein said containment membrane is a flexible, waterproof and durable membrane, said containment membrane having a breaking strength of about 55-100 lbs. as tested per ASTM D 751 Procedure B, said containment membrane having an elongation of about 35-70% when tested per ASTM D 751, said containment membrane having a low temperature flexibility of at least −10° F. when tested by ASTM D 2136, said containment membrane resisting tearing at force of at least 20 lbf. as measured per ASTM D 751.

8. The method as defined in claim 1, wherein said step of forming forms said liquid-proof or liquid-resistant heat-created melted seam.

9. The method as defined in claim 1, including the step of adding a curb to at least a portion of a perimeter of said containment system, a top of said curb having a height of at least two inches above a top surface of said containment membrane, said curb creating a liquid-proof or liquid-resistant barrier with said containment membrane.

10. The method as defined in claim 9, wherein said step of adding said curb including the steps of:

i. providing a compressible material that is compressible when a compression force is applied to said compressible material and which also retains is original shape after said compression force is removed from said compressible material;

ii. positioning said compressible material on a top surface of said containment membrane near a perimeter of said containment system;

iii. folding a side portion of said containment membrane over and about said compressible material and overlapping a portion of said side portion with a top surface of said containment membrane; and, iv. securing said overlapping portion of said side portion to said top surface of said containment membrane.

11. The method as defined in claim 10, wherein said compressible material is a high-density foam material.

12. The method as defined in claim 10, wherein said step of securing is by a heat process to form a melted seam.

13. The method as defined in claim 10, wherein said overlapped portion of said side portion overlaps at least two inches of said top surface of said containment membrane.

14. The method as defined in claim 1, wherein said strips of containment membrane are sloped on said site to direct liquids spilled on said top surface of said containment membrane toward internal drains in said containment system.

15. The method as defined in claim 1, wherein said liquid-proof or liquid- resistant seam between said overlapped side edges of said adjacently positioned strips of containment membrane has a seam strength of at least about 50 lbf. before the watertight integrity of said seam is compromised per ASTM D 751.

16. The method as defined in claim 1, wherein said adjacently positioned strips of containment membrane are overlapped by at least two inches.

17. The method as defined in claim 1, wherein said top surface of the polymer waterproof layer includes a textured pattern to form a slip-resistant surface, said textured pattern having a roughness average ($R_a$) in μm is 15-80.

18. A containment system comprising a plurality of strips of a liquid-proof containment membrane that are positioned on a worksite, said containment membrane capable of blocking contaminants from seeping therethrough, said containment membrane having a top and bottom surface and comprising a polymer waterproof layer forming said top surface of said container membrane and a reinforcement layer that is at least partially embedded in said polymer waterproof layer, said reinforcement layer positioned below said top surface of said containment membrane, said polymer waterproof layer has a thickness that is greater than a thickness of said reinforcement layer, said top surface of said polymer waterproof layer is textured to form a non-smooth surface to form a slip-resistant top surface for improving foot traction when wet, said containment system further comprising adjacently positioned strips of said containment membrane having overlapping side edges that are overlapping by at least two inches, said overlapping side edges connected together by a liquid- proof or liquid- resistant seam formed by an adhesive or a melted bond, said liquid-proof or liquid- resistant seam having a seam strength of at least about 50 lbf. before the watertight integrity of said seam is compromised per ASTM D 751, said bottom surface of each strip of containment membrane facing a top surface of the worksite.

19. The containment system as defined in claim 18, wherein said reinforcement layer is a woven fabric material.

20. The containment system as defined in claim 19, wherein said polymer waterproof layer has a thickness of about 40 to about 80 mils, said reinforcement layer has a thickness of about 10 to about 15 mils.

21. The containment system as defined in claim 19, wherein said polymer waterproof layer is greater than 70% of a thickness of said containment membrane.

22. The containment system as defined in claim 18, wherein said polymer waterproof layer includes polyvinyl chloride, said reinforcement layer comprising a fabric of woven fibers.

23. The containment system as defined in claim 18, wherein a top surface of said polymer waterproof layer has a textured surface having a $R_a$ of at least 20 μm.

24. The containment system as defined in claim 18, wherein said containment membrane is a flexible, waterproof and durable membrane, said containment membrane having a breaking strength of about 55-100 lbs. as tested per ASTM D 751 Procedure B, said containment membrane having an elongation of about 35-70% when tested per ASTM D 751, said containment membrane having a low temperature flexibility of at least −10° F. when tested by ASTM D 2136-02, said containment membrane resisting tearing at force of at least 20 lbf. as measured per ASTM D 751.

25. The containment system as defined in claim 18, including a curb positioned about at least a portion of a perimeter of said containment system, a top of said curb having a height of at least two inches above a top surface of said containment membrane, said curb creating a liquid-proof or liquid-resistant barrier with said containment membrane.

26. The containment system as defined in claim 25, wherein said curb formed of a compressible material that is compressible when a compression force is applied to said compressible material and which also regains its original shape after said compression force is removed from said compressible material, a majority of said compressible material encircled by said containment membrane, overlapping portions of said containment membrane sealed together to secure said at least partially encircled compressible material in position.

27. The containment system as defined in claim 26, wherein said compressible material is a high-density foam material.

28. The containment system as defined in claim 26, wherein said overlapping portions of said containment membrane that are sealed together are sealed together by a melted seam, said melted seam having a width of at least two inches.

29. The containment system as defined in claim 18, wherein said top surface of the polymer waterproof layer includes a textured pattern to form a slip-resistant surface, said textured pattern having a roughness average ($R_a$) in μm is 15-80.

30. A method for protecting an area of ground in a worksite by forming a containment system comprising the steps of:

providing a plurality of strips of a liquid-proof containment membrane capable of blocking contaminants from seeping therethrough, each strip of said containment membrane having a top and bottom surface and consisting of a polymer waterproof layer forming said top surface of said containment membrane and a reinforcement layer that is at least partially embedded in said polymer waterproof layer, said reinforcement layer positioned below said top surface of said containment membrane, said reinforcement layer is a woven fabric material, said polymer waterproof layer has a thickness that is greater than a thickness of said reinforcement layer, said polymer waterproof layer is greater than 70% of a thickness of said containment membrane, said polymer waterproof layer includes polyvinyl chloride, said reinforcement layer comprising a fabric of woven fibers, said top surface of said polymer waterproof layer textured to form a non-smooth surface to form a slip-resistant top surface for improving foot traction when wet, said containment membrane is a flexible, waterproof and durable membrane, said containment membrane having a breaking strength of about 55-100 lbs. as tested per ASTM D 751 Procedure B, said containment membrane having an elongation of about 35-70% when tested per ASTM D 751, said containment membrane having a low temperature flexibility of at least −10° F. when tested by ASTM D 2136, said containment membrane resisting tearing at force of at least 20 lbf. as measured per ASTM D 751;

arranging said plurality of strips of containment membrane on the worksite to cover a top surface of the worksite and to cause adjacently positioned strips of said containment membrane to overlap at a side edge of each of said adjacently positioned strips of said containment membrane, said bottom surface of each strip of containment membrane facing said top surface of the worksite; and, forming a liquid-proof or liquid-resistant heat-created melted seam between said overlapped side edges of said adjacently positioned strips of said containment membrane to form said containment system on said worksite.

31. The method as defined in claim 30, including the step of adding a curb to at least a portion of a perimeter of said containment system, a top of said curb having a height of at least two inches above a top surface of said containment membrane, said curb creating a liquid-proof or liquid-resistant barrier with said containment membrane, said step of adding said curb including the steps of:

i. providing a compressible material that is compressible when a compression force is applied to said compressible material and which also retains its original shape after said compression force is removed from said compressible material;

ii. positioning said compressible material on a top surface of said containment membrane near a perimeter of said containment system;

iii. folding a side portion of said containment membrane over and about said compressible material and overlapping a portion of said side portion with a top surface of said containment membrane; and, iv. securing said overlapping portion of said side portion to said top surface of said containment membrane by a heat-created seam.

* * * * *